US011867400B1

(12) United States Patent
Hu

(10) Patent No.: US 11,867,400 B1
(45) Date of Patent: Jan. 9, 2024

(54) COMBUSTOR WITH FUEL PLENUM WITH MIXING PASSAGES HAVING BAFFLES

(71) Applicant: Pratt & Whitney Canada Corp., Longueuil (CA)

(72) Inventor: Tin Cheung John Hu, Markham (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 18/104,935

(22) Filed: Feb. 2, 2023

(51) Int. Cl.
*F23R 3/28* (2006.01)

(52) U.S. Cl.
CPC ..... *F23R 3/286* (2013.01)

(58) Field of Classification Search
CPC .... F23R 3/286; F23R 3/34; F23R 3/12; F23R 2900/00002; F23C 2900/9901; B05B 1/14; F23D 14/02; F23D 14/70; F23D 14/78
See application file for complete search history.

(56) References Cited

U.S. PATENT DOCUMENTS 3,617,001 A 11/1971 Grundham et al.
4,986,068 A 1/1991 Lee et al.
6,267,585 B1 * 7/2001 Suttrop ..... F23D 14/70 431/278
6,442,939 B1 * 9/2002 Stuttaford ..... F23D 14/64 60/737
7,832,212 B2 11/2010 Bunker
7,870,736 B2 * 1/2011 Homitz ..... F23R 3/286 60/737
8,266,911 B2 9/2012 Evulet
8,413,445 B2 * 4/2013 Poyyapakkam ..... F23D 14/82 60/737
8,539,773 B2 * 9/2013 Ziminsky ..... F23R 3/34 60/737
8,661,779 B2 3/2014 Laster et al.
8,893,500 B2 11/2014 Oskam
9,353,950 B2 * 5/2016 Uhm ..... F23R 3/10
9,771,869 B2 9/2017 Li et al.
9,976,522 B2 5/2018 Patel et al.
10,082,294 B2 9/2018 Laster et al.
10,267,522 B2 4/2019 Ciani et al.
10,386,074 B2 8/2019 Arellano et al.
10,502,425 B2 12/2019 Boardman et al.
10,704,786 B2 7/2020 Laster et al.
(Continued)

FOREIGN PATENT DOCUMENTS

BR 112021013983 A2 * 9/2021 ..... G21B 3/004
CN 101220955 7/2008
(Continued)

*Primary Examiner* — Craig Kim
(74) *Attorney, Agent, or Firm* — Carlson, Gaskey & Olds, P.C.

(57) ABSTRACT

A combustor for a gas turbine engine includes a liner surrounding a fuel and air mixing body. A gaseous fuel supply passage delivers gaseous fuel into the mixing body. A wall of the mixing body has air openings to communicate air into mixing passages. At least one fuel opening in each of the mixing passages allows fuel to flow into the mixing passages and mix with the air. There are passage sections downstream of a location of the fuel openings, such that the mixed air and fuel travel downstream of the location and into a combustion chamber. The passage sections have baffles that create a tortuous path. A gas turbine engine is also disclosed.

14 Claims, 2 Drawing Sheets

(56) References Cited

U.S. PATENT DOCUMENTS

| | | | | |
|---|---|---|---|---|
| 10,775,047 | B2 * | 9/2020 | Horikawa | F23D 14/70 |
| 10,865,989 | B2 | 12/2020 | Sadasivuni | |
| 10,941,940 | B2 | 3/2021 | Bulat et al. | |
| 11,067,280 | B2 | 7/2021 | Boardman et al. | |
| 11,286,884 | B2 * | 3/2022 | Boardman | F23R 3/12 |
| 11,428,405 | B2 * | 8/2022 | Bijkerk | F23D 14/02 |
| 11,558,004 | B1 * | 1/2023 | Roychoudhury | H02S 10/10 |
| 11,649,966 | B1 * | 5/2023 | Patra | F23D 14/64 60/737 |
| 2010/0252652 | A1 * | 10/2010 | Johnson | F23R 3/286 239/548 |
| 2011/0057056 | A1 * | 3/2011 | Ziminsky | F23D 14/48 239/398 |
| 2011/0073684 | A1 * | 3/2011 | Johnson | F23R 3/286 239/553.5 |
| 2011/0185703 | A1 | 8/2011 | Dodo et al. | |
| 2012/0227411 | A1 | 9/2012 | Carroni et al. | |
| 2013/0074510 | A1 * | 3/2013 | Berry | F23R 3/286 60/734 |
| 2013/0306181 | A1 * | 11/2013 | Mitchell | F23L 15/04 137/888 |
| 2014/0060063 | A1 * | 3/2014 | Boardman | F23R 3/286 60/737 |
| 2017/0227224 | A1 | 8/2017 | Oskam et al. | |
| 2017/0307210 | A1 | 10/2017 | Hirano et al. | |
| 2019/0011132 | A1 * | 1/2019 | Camponovo | F23R 3/34 |
| 2021/0102703 | A1 * | 4/2021 | Tada | F02C 7/22 |
| 2021/0172413 | A1 | 6/2021 | Snyder | |
| 2023/0176557 | A1 * | 6/2023 | Cella | G05B 19/4184 700/117 |

FOREIGN PATENT DOCUMENTS

| | | | | |
|---|---|---|---|---|
| CN | 102032576 | A * | 4/2011 | F23D 14/64 |
| CN | 206113000 | | 4/2017 | |
| CN | 109312925 | B * | 10/2020 | F02C 7/222 |
| CN | 217604084 | U * | 10/2022 | |
| DE | 102010016547 | B4 * | 3/2023 | F23R 3/28 |
| EP | 1923637 | | 5/2008 | |
| EP | 4027059 | A1 * | 7/2022 | |
| JP | 2013108667 | | 6/2013 | |
| JP | 5538113 | | 7/2014 | |
| JP | 5926635 | | 5/2016 | |
| WO | WO-2014099087 | A2 * | 6/2014 | F02C 3/107 |
| WO | 2016051756 | | 4/2016 | |
| WO | 2020259919 | | 12/2020 | |

* cited by examiner

COMBUSTOR WITH FUEL PLENUM WITH MIXING PASSAGES HAVING BAFFLES

BACKGROUND

This application relates to a combustor wherein passages are provided with baffles to mix a fuel with air.

Gas turbine engines are known, and typically include a compressor delivering compressed air into a combustor. Compressed air is mixed with fuel and ignited. Products of the combustion pass downstream over turbine rotors, driving them to rotate. The turbine rotors in turn rotate the compressor rotors and propulsor rotors such as a fan or propeller.

Historically, aviation fuel has been utilized with gas turbine engines, especially for aircraft applications. More recently it has been proposed to utilize hydrogen ($H_2$) as a fuel.

SUMMARY

A combustor for a gas turbine engine includes a liner surrounding a fuel and air mixing body. A gaseous fuel supply passage delivers gaseous fuel into the mixing body. A wall of the mixing body has air openings to communicate air into mixing passages. At least one fuel opening in each of the mixing passages allows fuel to flow into the mixing passages and mix with the air. There are passage sections downstream of a location of the fuel openings, such that the mixed air and fuel travel downstream of the location and into a combustion chamber. The passage sections have baffles that create a tortuous path.

These and other features will be best understood from the following drawings and specification, the following is a brief description.

DETAILED DESCRIPTION

Figure 1:
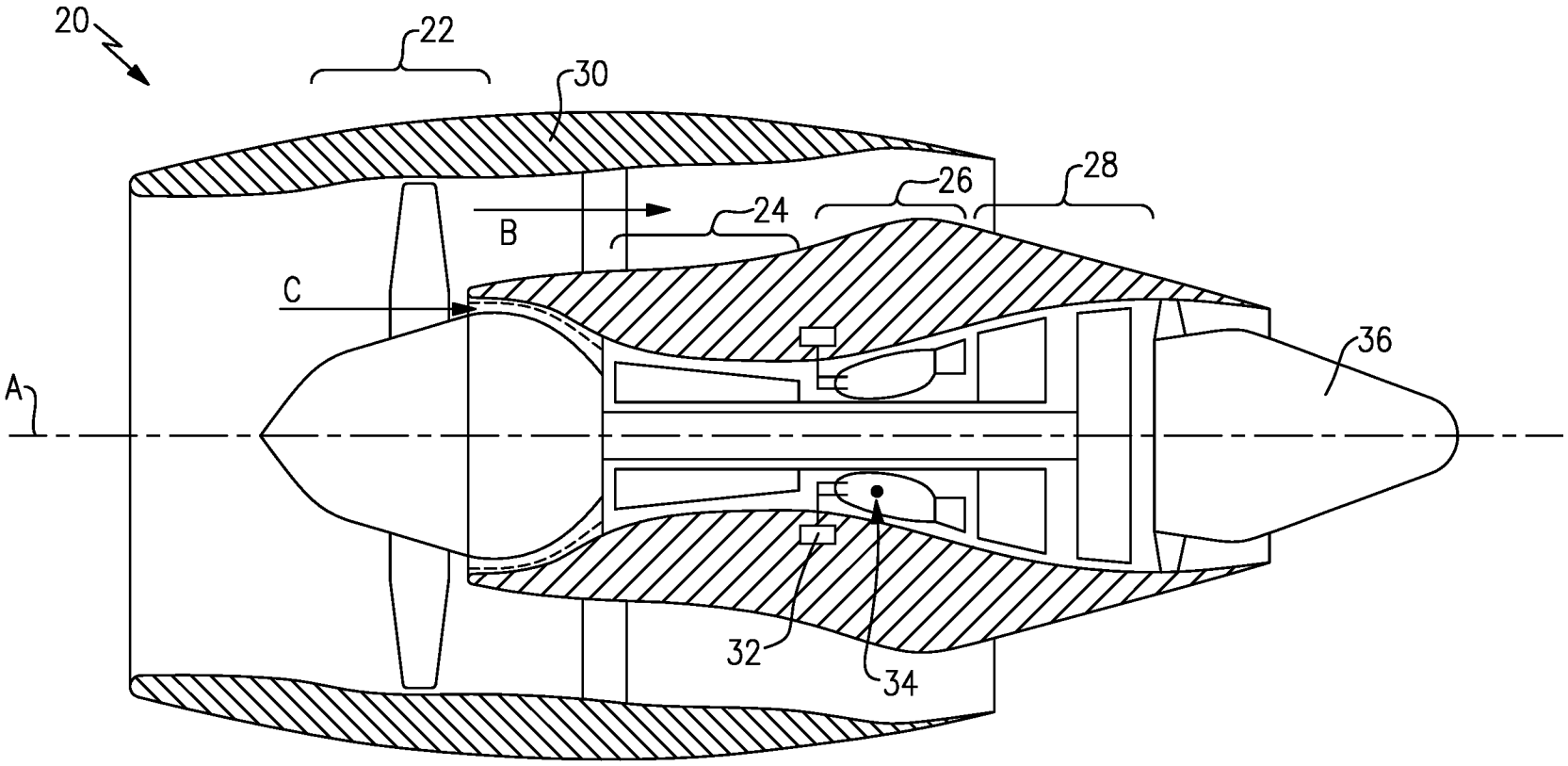
FIG. 1 schematically shows a gas turbine engine.

FIG. 1 schematically illustrates a gas turbine engine 20. The example gas turbine engine 20 is a turbofan that generally incorporates a fan section 22, a compressor section 24, a combustor section 26 and a turbine section 28. The fan section 22 drives air along a bypass flow path B in a bypass duct defined within a nacelle 30. The turbine engine 20 intakes air along a core flow path C into the compressor section 24 for compression and communication into the combustor section 26. In the combustor section 26, the compressed air is mixed with fuel from a fuel system 32 and ignited by igniter 34 to generate an exhaust gas flow that expands through the turbine section 28 and is exhausted through exhaust nozzle 36. Although depicted as a turbofan turbine engine in the disclosed non-limiting embodiment, it should be understood that the concepts described herein are not limited to use with turbofans as the teachings may be applied to other types of turbine engines. As one example, rather than having the propulsor be an enclosed fan, the propulsor may be an open propeller. This embodiment can also be applied to industrial gas turbine engine as well.

A gas turbine engine as disclosed in this application will utilize hydrogen ($H_2$) as a fuel. Challenges are faced by the use of hydrogen, and in particular combustor structure which might be appropriate for aviation fuel may not be as applicable to hydrogen as a fuel.

One challenge when utilizing hydrogen as a fuel is that it is in a gaseous state inside the combustor and more readily flammable than liquid aviation fuel. This could raise challenges with flashback if the local flame speed is higher than the fuel-air mixture inlet speed into the combustor.

Figure 2B:
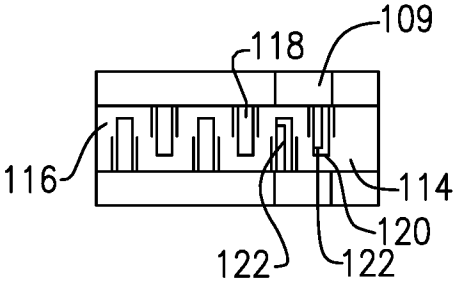
FIG. 2B shows a detail of FIG. 2A.
Figure 2A:
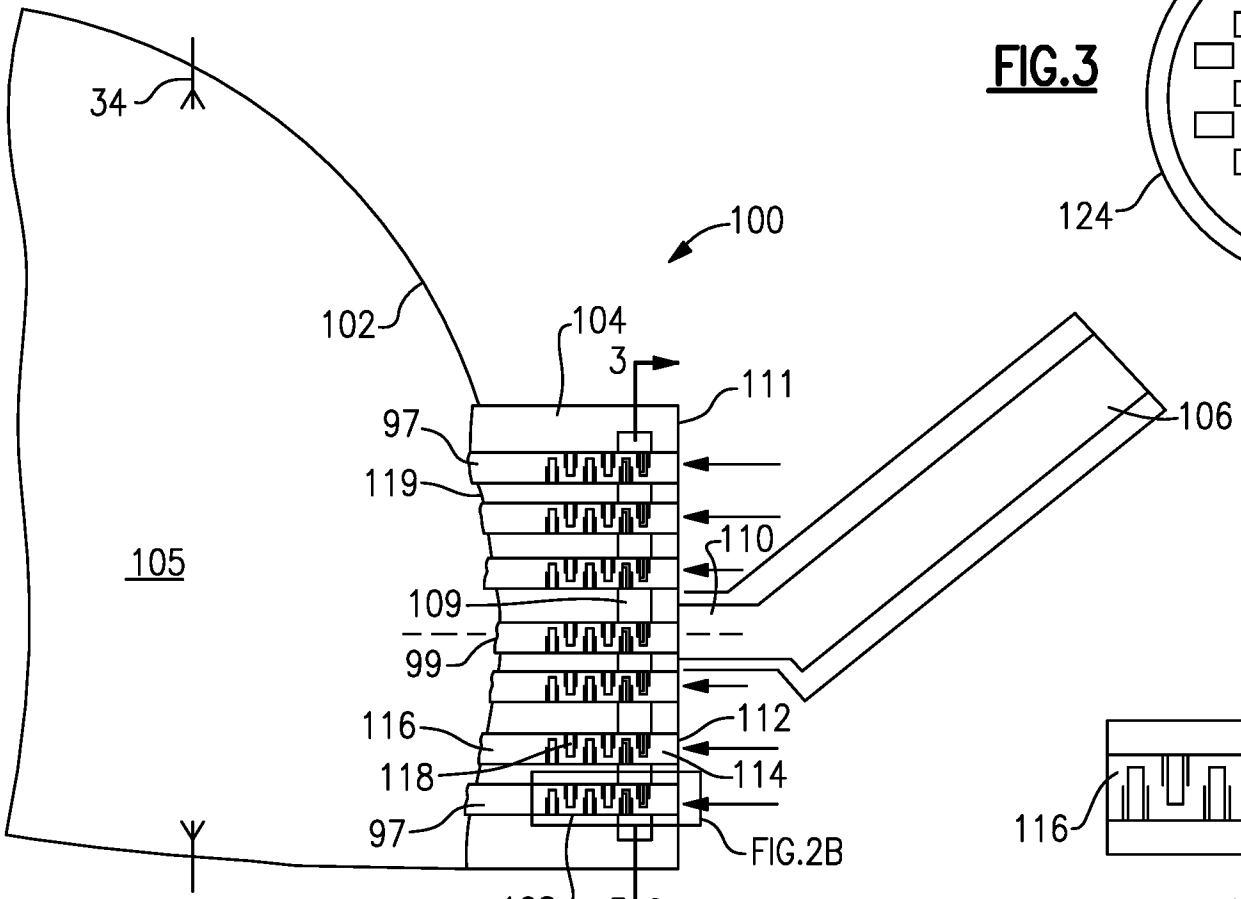
FIG. 2A shows a combustor for use in a gas turbine engine combustor.

FIG. 2A shows a combustor section 100 which is designed to delay ignition downstream of a hydrogen feed. The combustor 100 has a shell or liner 102 (shown partially) extending around an axis of rotation of the engine such as the engine shown in FIG. 1. Ignition structure 34 is shown schematically.

An air and fuel mixing body 104 is secured to one end of liner 102. An end face 111 of mixing body 104 has air inlets 112 delivering air into mixing passages 114. A fuel supply 106 communicates with a central fuel passage 110. From fuel passage 110, fuel flows into a fuel plenum 109. Gaseous hydrogen fuel in the plenum 109 may then move into the mixing passages 114. As shown (FIG. 2B), small openings 122 in baffle injectors 120 communicate the plenum 109 into the passages 114. Passage sections 108 extend downstream of the plenum 109, and include structure to delay ignition.

As further shown, there is a tortuous flow path between the initial section of mixing passages 114 and passage sections 116 downstream of the fuel plenum 109. The tortuous path is provided by a plurality of baffles 118 and baffle injectors 120. The tortuous path promotes uniform mixing of the fuel and air.

Figure 3:
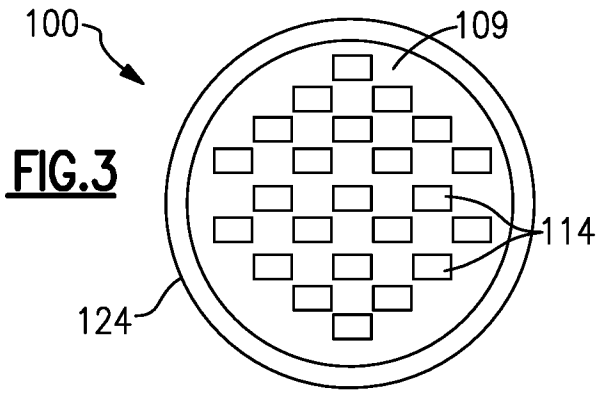
FIG. 3 is a cross-sectional view along line 3-3 of FIG. 2A.

As is also clear from FIGS. 2A and 3, there are mixing passages 114 circumferentially and radially spaced about an axis of the fuel supply passage 110. Outlets 99 of some mixing passage sections 116 closer to an axis of the fuel supply passage 110 extend for a shorter axial distance than do outlets 97 which are spaced further in each direction relative to the central axis of the fuel supply passage 110. In this manner, the inner face 119 of the mixing body 104 is non-planar. The concave shape of the inner face allows protrusion of the individual passages into the combustor for distinct lengths to optimize flame stability.

FIG. 2B shows details of the baffles 118 and 120 within the passages 114/116. There are solid baffles 118. Baffle injectors 120, which are at an axial location within the fuel plenum 109, have an injection port 122 to deliver the fuel into the mixing passages 114 for mixing with the air. The baffles 118 and 120 create a tortuous path to mix the fuel and air.

As can be seen there are at least two injection baffles 120 in each mixing passages and at least four of the solid baffles. As can be seen in FIG. 2A, downstream most ends of passage sections 116 are free of baffles. That is the baffles are not formed all the way to inner face 119 of mixing body 104.

By having the passage sections 108/116 downstream of the plenum 109, the ignition will occur downstream of the outlets 97/99 into combustor 105. The baffles 118/120 resist fuel flashback from the combustion chamber upstream and toward fuel supply passage 110.

Each mixing passage exit 97, 116, 99, 97 can be sized to have the mixture injection speed to be higher than the local flame speed inside the combustor. This will be another flashback feature with this embodiment.

FIG. 3 shows an outer periphery 124 of the combustor section 100. One can see the mixing passages 114 and the plenum 109.

The outer periphery 124 is shown as cylindrical while the mixing passages are rectangular in section. Of course other shapes can be used.

In a featured embodiment, a combustor 100 for a gas turbine engine under this disclosure could be said to include a liner 102 surrounding a fuel and air mixing body 104. A fuel supply passage 110 communicates into the mixing body. A wall 111 of the mixing body has air openings 112 to communicate air into mixing passages 114. At least one fuel opening 122 in each of the mixing passages allows fuel to flow into the mixing passages and mix with the air. There are passage sections 116 downstream of a location of the fuel openings, such that the mixed air and fuel travel downstream of the location and into a combustion chamber 105. The passage sections have baffles 118/120 that create a tortuous path.

In another embodiment according to the previous embodiment, a source of gaseous fuel is connected to the gaseous fuel supply passage, and the source of fuel is hydrogen.

In another embodiment according to any of the previous embodiments, the fuel from the fuel supply passage passes into a fuel plenum 109, then into the mixing passages through the at least one fuel opening.

In another embodiment according to any of the previous embodiments, each of the mixing passages have at least one of the baffles 120 with the at least one fuel opening 122 to communicate fuel from the fuel plenum into the mixing passages.

In another embodiment according to any of the previous embodiments, there are also solid ones of the baffles 118.

In another embodiment according to any of the previous embodiments, the fuel supply passage is at a generally central location in the fuel mixing body, with the fuel plenum extending both circumferentially and radially on both sides of an axis of the fuel supply passage.

In another embodiment according to any of the previous embodiments, an inner face of the mixing body at the combustion chamber is generally non-planar 119.

In another embodiment according to any of the previous embodiments, some of the passage sections 99 which are closer to the axis of the fuel supply passage extend for a shorter axial length than others 97 of said passage sections spaced further from said axis.

In another embodiment according to any of the previous embodiments, the fuel from the fuel supply passage passing into a fuel plenum 109, then into the mixing passages through the at least one fuel opening.

In another embodiment according to any of the previous embodiments, each of the mixing passages have at least one of the baffles 120 with the at least one fuel opening 122 to communicate fuel from the fuel plenum into the mixing passages. There are also solid ones of the baffles 118.

A gas turbine engine incorporating any of the above features is also disclosed and claimed.

Although embodiments have been disclosed, a worker of skill in this art would recognize that modifications would come within the scope of this disclosure. For that reason, the following claims should be studied to determine the true scope and content.

What is claimed is:

1. A combustor for a gas turbine engine comprising:

a liner surrounding a gaseous fuel and air mixing body;

a gaseous fuel supply passage for delivering fuel into the mixing body;

a wall of the mixing body having air openings to communicate air into mixing passages, at least one fuel opening in each of the mixing passages allows fuel to flow into the mixing passages and mix with the air, and passage sections downstream of a location of the fuel openings, such that said mixed air and fuel travel downstream of the location and into a combustion chamber;

the passage sections having baffles that create a tortuous path;

the fuel from the fuel supply passage passing into a fuel plenum, then into the mixing passages through the at least one fuel opening; and each of the mixing passages have at least one of the baffles with the at least one fuel opening to communicate fuel from the fuel plenum into the mixing passages.

2. The combustor as set forth in claim 1, wherein a source of gaseous fuel is connected to the gaseous fuel supply passage, and the source of fuel is hydrogen.

3. The combustor as set forth in claim 2, wherein there are also solid ones of the baffles.

4. The combustor as set forth in claim 1, wherein said fuel supply passage is at a generally central location in the fuel mixing body, with the fuel plenum extending both circumferentially and radially on both sides of an axis of the fuel supply passage.

5. The combustor as set forth in claim 4, wherein an inner face of the mixing body at the combustion chamber is generally non-planar.

6. The combustor as set forth in claim 5, wherein some of said passage sections which are closer to the axis of the fuel supply passage extend for a shorter axial length than others of said passage sections spaced further from said axis.

7. The combustor as set forth in claim 1, wherein there are also solid ones of the baffles.

8. A gas turbine engine comprising:

a compressor section and a turbine section;

a combustor intermediate said compressor section and said turbine section;

a gaseous fuel supply for delivering gaseous fuel into a mixing body in the combustor;

a liner surrounding the mixing body;

a wall of the mixing body having air openings to communicate air into mixing passages, at least one fuel opening in each of the mixing passages allows fuel to flow into the mixing passages and mix with the air, and passage sections downstream of a location of the fuel openings, such that said mixed air and fuel travel downstream of the location and into a combustion chamber;

the passage sections having baffles that create a tortuous path;

the fuel from the fuel supply passage passing into a fuel plenum, then into mixing passages through the at least one fuel opening; and each of the mixing passages have at least one of the baffles with the at least one fuel opening to communicate fuel from the fuel plenum into the mixing passages.

9. The gas turbine engine as set forth in claim 8, wherein a source of gaseous fuel is connected to the gaseous fuel supply passage, and the source of fuel is hydrogen.

10. The gas turbine engine as set forth in claim 9, wherein there are also solid ones of the baffles.

11. The gas turbine engine as set forth in claim 8, wherein said fuel supply passage is at a generally central location in the fuel mixing body, with the fuel plenum extending both circumferentially and radially on both sides of an axis of the fuel supply passage.

12. The gas turbine engine as set forth in claim 11, wherein an inner face of the mixing body at the combustion chamber is generally non-planar.

13. The gas turbine engine as set forth in claim 12, wherein some of the passage sections which are closer to the axis of the fuel supply passage extend for a shorter axial length than others of said passage sections spaced further from said axis.

14. The gas turbine engine as set forth in claim 8, wherein there are also solid ones of the baffles.

* * * * *